United States Patent [19]

Casper

[11] 4,250,990

[45] Feb. 17, 1981

[54] INFUSION BAG WITH CROSSBAR SUSPENSION

[76] Inventor: Diane Casper, 35 E. 85th St., New York, N.Y. 10028

[21] Appl. No.: 68,396

[22] Filed: Aug. 21, 1979

Related U.S. Application Data

[63] Continuation of Ser. No. 886,940, Mar. 15, 1978.

[51] Int. Cl.[3] ..... B65B 29/02; B30B 5/02; B65D 85/00

[52] U.S. Cl. ..... 206/0.5; 220/85 R; 426/80; 248/113; 206/806

[58] Field of Search ..... 206/0.5, 45.14, 45.33, 206/806; 426/80–84; 248/113; 220/90, 85 R

[56] References Cited

U.S. PATENT DOCUMENTS

| | | | |
|---|---|---|---|
| 2,468,631 | 4/1949 | Jauss | 248/113 |
| 2,728,672 | 12/1955 | Young et al. | 206/0.5 |
| 2,752,035 | 6/1956 | Shinoda | 206/45.14 |
| 3,057,729 | 10/1962 | Grant | 206/0.5 |
| 3,092,242 | 6/1963 | Irmscher | 206/0.5 |
| 3,338,393 | 8/1967 | Abel | 206/45.33 |

*Primary Examiner*—William T. Dixson, Jr.
*Attorney, Agent, or Firm*—Ostrolenk, Faber, Gerb & Soffen

[57] ABSTRACT

A disposable infusion bag capable of containing tea or the like which is immersible in a cup of hot water and suspended from a crossbar resting on opposite sides of the rim of the cup. The crossbar is in the form of an inverted "V" comprised of a squeezable pair of plates so that the infusion bag can be drawn up into the apex of the crossbar to squeeze off excess water before disposal. The crossbar is also designed to fit various sizes of cups and contains a suitable hole for passage of a thread or filament of plastic or other supporting means.

2 Claims, 3 Drawing Figures

INFUSION BAG WITH CROSSBAR SUSPENSION

This is a continuation of application Ser. No. 886,940, filed Mar. 15, 1978.

BACKGROUND OF THE INVENTION

This invention relates generally to an infusion bag and suspending means which facilitates handling an infusion thereof, and, more particularly, to a tea bag assembly.

The ordinary infusion bag comes with a string attached for manipulation of the bag, for immersion of the bag into the liquid of a cup, and for withdrawal when sufficient steeping has been achieved. Devices for suspending the infusion bag from a cup, previously known in the art, include suspension from a lid as in U.S. Pat. No. 3,861,284, and 2,918,373, and by a device supported by the cup rim, as in U.S. Pat. No. 3,895,118.

Lid type devices completely cover the mouth of the cup and require repeated removal of the lid to check on the steeping rate in order to avoid producing a drink not sufficiently steeped or one steeped so strongly that it has become bitter. Moreover, the construction of a lid can add unnecessary cost to the infusion bag. Prior art devices supported by the cup rim have tended to be unbalanced, which can result in the bag falling in the cup.

SUMMARY OF THE INVENTION

The present invention provides an infusion bag assembly for tea or the like which comprises a porous bag for the infusion material, which may be tea, coffee cocoa or any other soluble food product. The bag is supported by a resilient filament like supporting means being secured to a crossbar adapted to fit over opposite portions of the rim of a cup. The crossbar will preferably have an inverted "V" shape and which will comprise a pair of squeezable plates which can be used to squeeze excess liquid from the infusion bag as it is lifted toward the apex of the crossbar. The crossbar may also have serrated lower surfaces so that it may sit securely and balance itself upon cups of various sizes.

In accordance with the crossbar type suspension of the present invention, the infusion bag will be balanced within the cup and hang freely so as to achieve maximum infusion rather than rest on the bottom or side of the cup and the crossbar will rest securely upon the rim of the cup. Moreover, since the crossbar suspension does not cover the entire mouth of the cup visual observation of the strength of the brew can be achieved without removing a cap or cover.

An additional advantage of the present invention is the easy disposal of the infusion bag without dripping excess liquid. This is accomplished by drawing the infusion bag up within the crossbar suspension. Once the bag is within the apex of the inverted "V" shape of the crossbar, the sides of the "V" of the crossbar act as squeezable plates which when pressed against the sides of the bag, cause the excess liquid to be forced out.

Figure 1:
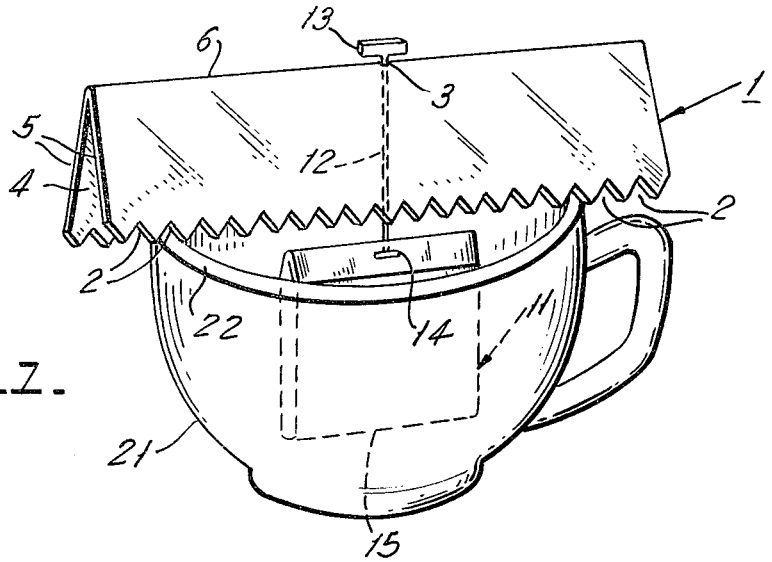
FIG. 1 is a perspective view of an infusion bag and crossbar suspension in accordance with the present invention adapted to be employed with a cup.

For the purpose of illustrating the invention, there is shown in the drawing a form which is presently preferred; it being understood, however, that this invention is not limited to the precise arrangements and instrumentalities shown.

DETAILED DESCRIPTION OF THE INVENTION

Referring now to the drawings and to FIG. 1 in particular, the reference character 1 generally indicates the crossbar suspension. This crossbar suspension 1 can be made of any sufficiently flexible material capable of being folded. The configuration of this crossbar suspension is that of an inverted "V" having an apex 6, its lower edges preferably having serrations 2, so that it can rest securely on any size cup. The crossbar suspension 1 rests over the cup 21 with the serrated edges 2 resting over opposite portions of the rim 22 of the cup in a manner which provides for secure positioning and prevents sliding. Located approximately midlength along the crossbar suspension 1 along the line of its apex is a hole 3 through which passes the flexible supporting means 12 such as a string or plastic filament to which the bag 11 is attached by means of a projection extending from the filament, a staple or other securing means shown as element 14. A knot or other projection 13 is located at the free end of the string or filament 12, which has a diameter larger than that of the hole 3 prevents the string from slipping into the cup. A typical type of filament used in the present invention is stringless tags as used in connection with the tagging of apparel items.

Figure 2:
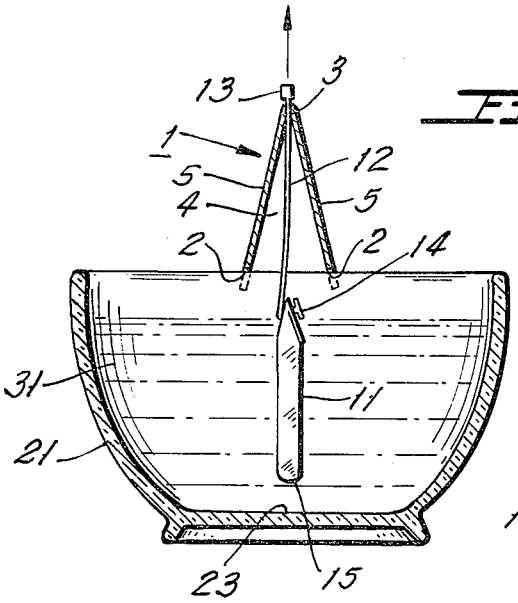
FIG. 2 is a vertical cross-sectional view of the infusion bag freely immersed in the liquid while suspended from the crossbar.

FIG. 2 illustrates the relative positioning of the bag 11 in the cup 21 when the tea or other soluble material is to be steeped. When the projection 13 rests upon the crossbar suspension 1 over the hole 3, the porous bag 11 is immersed within the liquid 31. The distance between the projection 13 and the position on the string where the staple 14 filament projections or other fastening means is attached to the bag is such that the bag 11 is supported at a level above the bottom of the cup 23 and held in a balanced position.

When the liquid 31 is sufficiently steeped with the tea or other infusible material, the bag 11 may be drawn up into the apex of the "V" of the crossbar by pulling upwardly upon the thread 12, as shown in FIG. 2.

Figure 3:
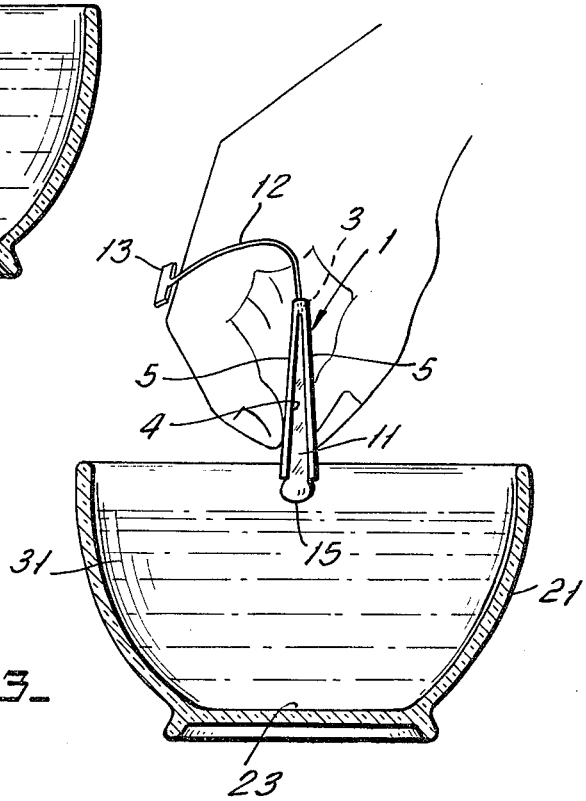
FIG. 3 is a vertical cross-sectional view of the infusion bag being squeezed to remove excess liquid after it was drawn up into the crossbar suspension.

FIG. 3 shows the bag 11 held within the interior cavity 4 of the crossbar suspension 1 after the thread 12 has been drawn up. Once the container is located in the cavity 4, the excess liquid retained by the porous walled container may be squeezed by applying pressure to the squeezables, plates or walls 5 of the crossbar suspension 1. This will eliminate the difficulties of disposing of a dripping tea bag after the appropriate brew has been prepared.

The present invention may be embodied in other specific forms without departing from the spirit or essential attributes thereof and, accordingly, reference should be made to the appended claims, rather than to the foregoing specification as indicated in the scope of the invention.

What is claimed is:

1. An infusion bag assembly for tea or other infusible material comprising a porous bag, resilient means for supporting said bag, said resilient supporting means comprising a filament slidably secured to a crossbar through a hole at the apex of said crossbar, said crossbar being adapted to fit over the rim of a cup, and comprising two elongated plates adapted to squeeze excess water from the infusion bag, said crossbar further being in the shape of an inverted "V" so as to provide visual observation of the interior of the cup without requiring its removal and further having serrated edges adapted to fit over the opposite portions of the rim of a cup and balance itself upon cups of various sizes.

2. The assembly of claim 1 in which the resilient means for supporting the bag is a plastic filament having an extension at one end for securing the same to the bag, and an extension at the other end to prevent it from passing completely through the hole.

* * * * *